US005456951A

United States Patent [19]

Sahoo

[11] Patent Number: 5,456,951

[45] Date of Patent: Oct. 10, 1995

[54] THERMAL SPRAY COATING CHAMBER AND METHOD OF USING SAME

[75] Inventor: Purusottam Sahoo, Collegeville, Pa.

[73] Assignee: Sermatech International, Inc., Limerick, Pa.

[21] Appl. No.: 164,374

[22] Filed: Dec. 9, 1993

[51] Int. Cl.[6] ..... B05D 1/08; B05B 15/12

[52] U.S. Cl. ..... 427/446; 427/456; 118/302; 118/326; 239/79

[58] Field of Search ..... 427/446, 456, 427/433; 118/326, 302; 239/79

[56] References Cited

U.S. PATENT DOCUMENTS

| | | | |
|---|---|---|---|
| 3,010,009 | 11/1961 | Ducati | 427/446 |
| 4,082,868 | 4/1978 | Schnedler et al. | 427/433 |
| 4,330,574 | 5/1982 | Pierson et al. | 427/433 |
| 5,389,407 | 2/1995 | Sokol | 427/450 |

FOREIGN PATENT DOCUMENTS

| | | | |
|---|---|---|---|
| 142358 | 6/1980 | Germany | 427/446 |
| 2-25558 | 1/1990 | Japan | 427/446 |

*Primary Examiner*—Shrive Beck
*Assistant Examiner*—Katherine A. Bareford
*Attorney, Agent, or Firm*—Reising, Ethington, Barnard & Perry

[57] ABSTRACT

A method for applying a thermal spray coating onto a substrate (24) includes the steps of providing chamber apparatus (10) including a chamber (16) having a gas flow assembly (23) that includes a gas injector (27) and a spray nozzle (30) therein for introducing, a gas and spray coating. The chamber has an adjustably sized restricted opening (18) that is continuously open to the ambient atmosphere (21) that is exterior of the chamber (16). The total gas flow is maintained from the gas flow assembly (23) at a predetermined rate based on the size of the restricted opening (18) and the amount of oxygen that is desired to be present during the spraying of the coating and thereafter until the spray coating solidifies on the substrate. Gas flow from the spray nozzle (30) is determined by optimum process parameters for coating specified materials. If the gas flow from the nozzle (30) is insufficient to provide the total gas flow, the gas injector (27) supplements the total gas flow.

8 Claims, 3 Drawing Sheets

THERMAL SPRAY COATING CHAMBER AND METHOD OF USING SAME

TECHNICAL FIELD

The field of this invention relates to the coating arts and more particularly to a spray chamber for thermal spray techniques, such as plasma spray methods and high velocity oxygen (or OXY) fuel processes (HVOF).

BACKGROUND OF THE DISCLOSURE

Thermal spraying techniques have been used to apply durable coatings to a wide range of substrates. These substrates can be metallic, composite, or ceramic. A wide variety of metallic alloys and ceramic compositions have been used as coating materials to provide improved hardness, corrosion resistance, wear resistance, oxidation resistance or other surface modifications to the substrate in combination with the appropriate surface texture. One desirable group of coating materials are the MCrA1Y family including nickel, cobalt, or other alloys. MCrAlY materials are generally ally comprised of a base metal M (including Ni,Co,Fe, and mixtures of these elements), Cr, Al and Y. Modifications of these coatings have included additions of other materials such as Si, Ta, Hf, W, Re and others, to enhance the resistance of such materials to high temperature oxidation and corrosion.

It has long been known that the presence of oxygen during the plasma or HVOF operation will often promote unwanted oxidation of the coating making the coating unacceptable. Because the ambient atmosphere contains approximately 21% $O_2$, i.e. 210,000 parts per million (ppm) of $O_2$, the need readily arises to remove the spray process from ambient atmosphere. As such, the spray operation has often been contained in an enclosed chamber to control the ambient atmosphere therein. One standard technique has been to create near vacuum conditions, under 175 torr, in an enclosed chamber with less than 5 ppm of $O_2$. These standard vacuum processes are often referred to as LPPS as trademarked by Electroplasma, Inc. (from low pressure plasma spray) or VPS for vacuum plasma spraying. One such process and chamber is disclosed in U.S. Pat. No. 4,853,250 issued to Boulos et al. on Aug. 1, 1989.

These LPPS methods also require sealed chambers with access doors that can be tightly sealed and mechanical pumps to create the vacuum within the chamber that adds to the expense of the chamber. Furthermore, the nature of the operation is that the doors must be opened and closed before and after each plasma coating operation which constrains this type of coating operation to a less efficient and more time consuming batch type operation.

It has been found that oxidation during the LPPS or VPS process occurs during two steps of the operation. Firstly, oxidation may occur as the powder particles are "air born" as it is being applied to the substrate. Secondly, oxidation may occur after application onto the substrate before it solidifies. While these LPPS and VPS chambers successfully removed most oxygen from the chamber, and thus are very effective in eliminating the oxidation during the particle "air born" phase of the application, the LPPS high temperatures and thus relatively slow cooling rates on the substrate allow most of the oxidation to occur during the cool down phase of the coating.

U.S. Pat. No. 4,587,135 issued to Diener et al. on May 6, 1986 discloses a plasma method using a closed chamber at elevated pressures set at 1–40 torr above atmospheric pressure. The pressure is controlled by a gas relief valve in communication with the interior of the chamber which allows escapement of the gas only when it exceed a predetermined pressure over ambient to minimize backwash or turbulence that might allow the introduction of oxygen back into the chamber.

Previous attempts to provide an adequately dense, adherent MCrA1Y coating and elimination of oxidation by using an open chamber have failed. Analysis of the failures indicate that the failure emanates from the high oxygen atmosphere and turbulence created by the thermal spray process. In an open chamber the introduction of a thermal spray nozzle and high volumes of inert or low oxygen gases might be viewed as a method of preventing coating oxidation and reaction. However, the high turbulence and resulting presence of significant concentrations of oxygen create unsatisfactory results.

The present invention relates to the fact that it has been found that most of the oxidation occurs after application of the coating onto the substrate. Lowering the temperatures of the substrate and thus shortening of the cool down period can reduce the oxidation even if higher oxygen content exists in the ambient plasma spray.

What is needed is a chamber free from seals and pressure relief valves in which the oxygen content can be adequately controlled by the input of displacing gases at controlled rates into the chamber that is continuously open through a restricted opening to the surrounding ambient atmosphere rather than by the evacuation of the oxygen from a sealed and enclosed chamber. It is thus possible to provide for a tunable chamber that can be easily adjusted to control the desired amount of the oxygen present during the spray coating operation.

SUMMARY OF THE DISCLOSURE

In accordance with one aspect of the invention, a method of applying a thermal spray coating includes the steps of providing a chamber having a gas flow assembly preferably including a thermal spray gun and a separate gas injector, therein for introducing a sprayed coating and gas respectively. The chamber has an adjustably sized restricted opening that is continuously open to the ambient atmosphere that is exterior of said chamber. A substrate is positioned in the chamber. The size of the restricted opening is adjusted. A gas flowing from the gas flow assembly substantially fills the chamber and displaces oxygen from the chamber through the restricted opening. The selected gas is 10 substantially non-reactive with respect to the substrate, the chamber, and the thermal spray coating. The coating is emitted from the spray gun nozzle and sprayed onto the substrate. The gas flow from the spray gun nozzle is predetermined by optimum process parameters for the coating material. A total gas flow is maintained from the gas flow assembly at a predetermined rate based on the size of the restricted opening and the amount of oxygen that is desired to be present during the spraying of the coating and thereafter until the spray coating cools on the substrate. If the gas flow from the spray nozzle is insufficient to provide the desired total gas flow, the gas injector supplements the total gas flow.

In accordance with another aspect of the invention, a method of applying a thermal spray coating provides a chamber having a spray gun nozzle and a separate purging gas injector therein. The chamber has a restricted opening that is continuously open to the ambient atmosphere that is exterior of the chamber. The opening may be a single aperture or the total area of an aperture and clearances between chamber walls and incoming lines for gases, gun power, robotics and other accessories.

A substrate that is to be coated is disposed in the chamber. The chamber is substantially filled with a gas flowing from the purging gas injector. The purging gas displaces oxygen from the chamber through the restricted opening. The purging gas is inert to the substrate, the chamber, and the thermal spray coating. The coating is then sprayed through the gas and onto the substrate. A gas flow from the gas injector is maintained at a rate to maintain a positive outward flow of purging gas through the restricted opening from the chamber to the ambient exterior about the chamber during the spraying of the coating and thereafter until the spray coating cools on the substrate.

The method desirably further includes the controlling the total flow rate of gas emitted from both the purging gas injector and spray nozzle. For certain chamber sizes, the total flow rate is approximately 1500 cubic feet per hour at ambient temperature and pressure. The total area of the opening for this application is preferably approximately 0.8 square inches.

It is preferable that the flow rate from the purging gas injector is approximately 800 cubic feet per hour at ambient temperature and pressure and the flow rate of carrier gas and plasma gas from the spray gun nozzle is approximately 700 cubic feet per hour at ambient temperature and pressure.

In accordance with a further aspect of the invention, an apparatus for applying a thermal spray coating onto a substrate includes a chamber housing defining a chamber and having a continuously open opening therethrough allowing fluid communication between the chamber and ambient exterior. A gas source is disposed within said chamber for releasing a displacement gas into said chamber forcing oxygen containing air out through said opening. A spray gun nozzle is disposed in the chamber for spraying the coating through said gas in the chamber and onto a substrate in said chamber. An adjustable pump mechanism provides an adjusted flow of gas from the gas source to continuously provide a desirable flow of gases through said continuously open opening.

The apparatus preferably has the spray gun nozzle and the gas source for said displacement gas includes a separate injector for emitting the displacement meant gas. The opening is sized to be a minimum of approximately 0.8 square inches and continuously allows the flow of purging gas from the interior of the chamber housing and the ambient exterior and the inward controlled flow of ambient exterior atmosphere into the chamber.

BRIEF DESCRIPTION OF THE DRAWING

Reference now is made to the accompanying drawings in which.

DETAILED DESCRIPTION OF THE PREFERRED EMBODIMENT

Figure 1:
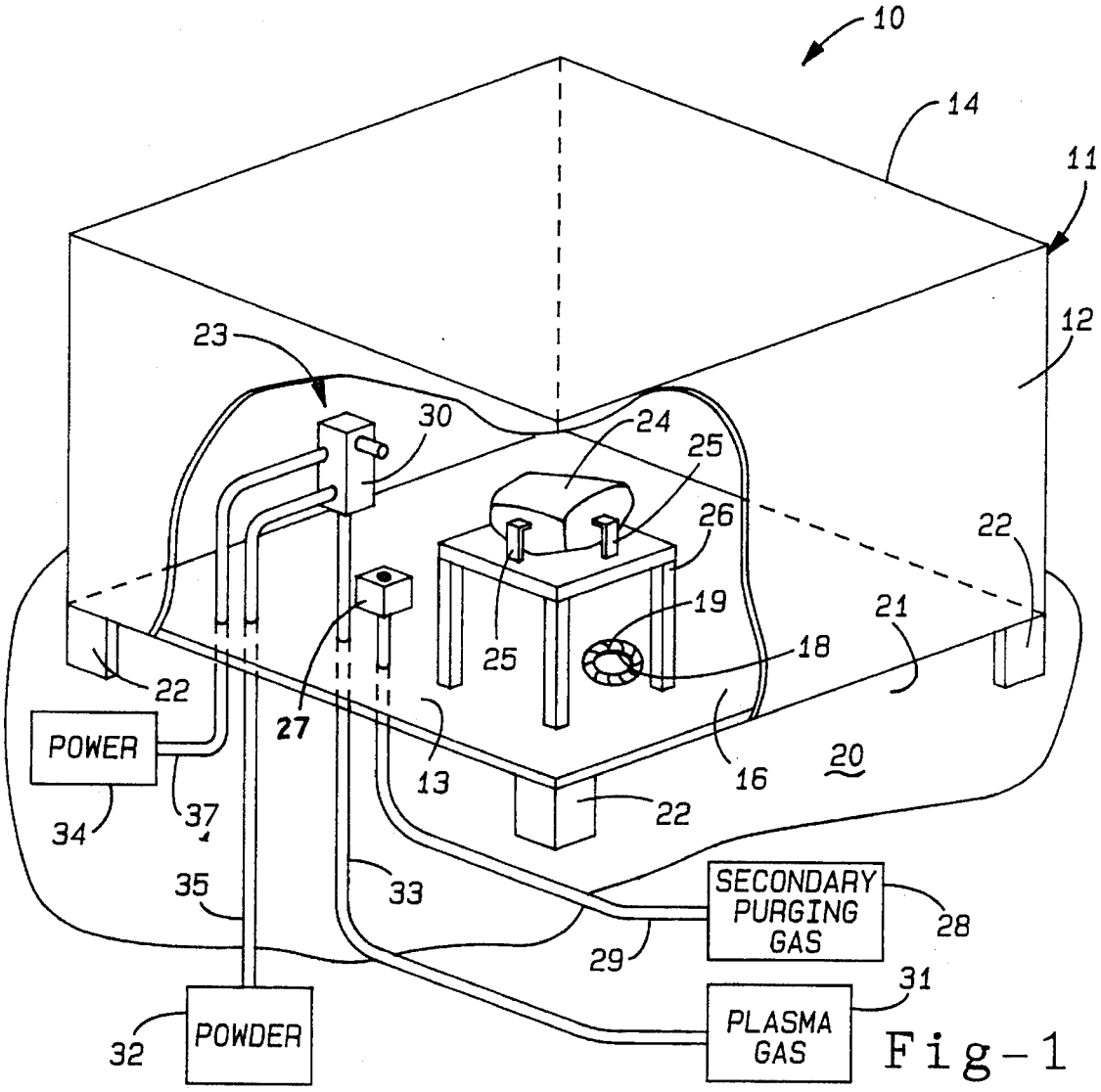
FIG. 1 is a perspective, fragmented, and schematic view of a spray apparatus including a chamber housing in accordance with one embodiment of the invention.

Referring now to FIG. 1, a spray coating apparatus 10 includes a chamber housing 11 having side walls 12, a top wall 14, and a bottom floor 13 defining a chamber 16 therein. The illustration of two of the side walls 12 shows them fragmented so that the chamber 16 and its interior components may be clearly illustrated. The floor 13 may be elevated by legs 22 from a base exterior surface 20. The floor 13 includes a continuously open aperture 18 for allowing free exchange of gases from the chamber 16 to the ambient exterior atmosphere 21. The size of the aperture 18 may be adjustable by use of an adjustable iris diaphragm 19 or similar device.

Patent application U.S. Ser. No. 806,848 filed on Dec. 9, 1991, now abandoned, by Larry Sokol and commonly owned with the present application discloses an open chamber construction and method of spraying in an open chamber is herein incorporated by reference.

The chamber has a substrate support 26 with appropriate hold down devices 25 for properly supporting and retaining a substrate 24 that is to be coated. A gas flow assembly generally referred to as numeral 23 includes a purging gas injector 27 and a plasma torch or spray nozzle 30. The purging gas injector 27 is mounted in the chamber 16. The purging gas injector 27 is operatively connected to a gas source 28 via line 29. The gas source 28 can supply the purging gas at various flow rates. The spray nozzle 30 is also mounted in chamber 16. The spray nozzle 30 commonly referred to as a spray gun can be one of various commercially available guns that is connected to a plasma gas source 31 via line 33, a source of coating material 32 via line 35, and a power source 34 via power line 37 operatively connected to the electrodes (not shown) of the spray gun 30. In High Velocity Oxy Fuel (HVOF) guns, electrodes are absent. Two types of gases, typically $O_2$ and a hydrocarbon or hydrogen combust to yield the heat, kinetic energy generation, and large volumes of gases.

In one version, the gas source 31 may be a gas that is inert with respect to the plasma, substrate, and chamber housing 11. Helium is a suitable gas. The purging gas source 28 may be an inert gas other than helium such as argon for economic reasons. In another embodiment, the nozzle 30 and purging gas injector 27 may both be connected to the same gas source 28. Preferably when the aperture 18 is at the floor, both gas sources 28 and 31 supply gases lighter than molecular oxygen. In another embodiment, the gas emitted from nozzle 30 is also used as the purging gas and injector 27 is eliminated. The chamber top 14 or side walls 12 may have an access door (not shown) to allow mounting and removal of the substrate as well as access for repairing nozzle 30 and injector 27.

Figure 2:
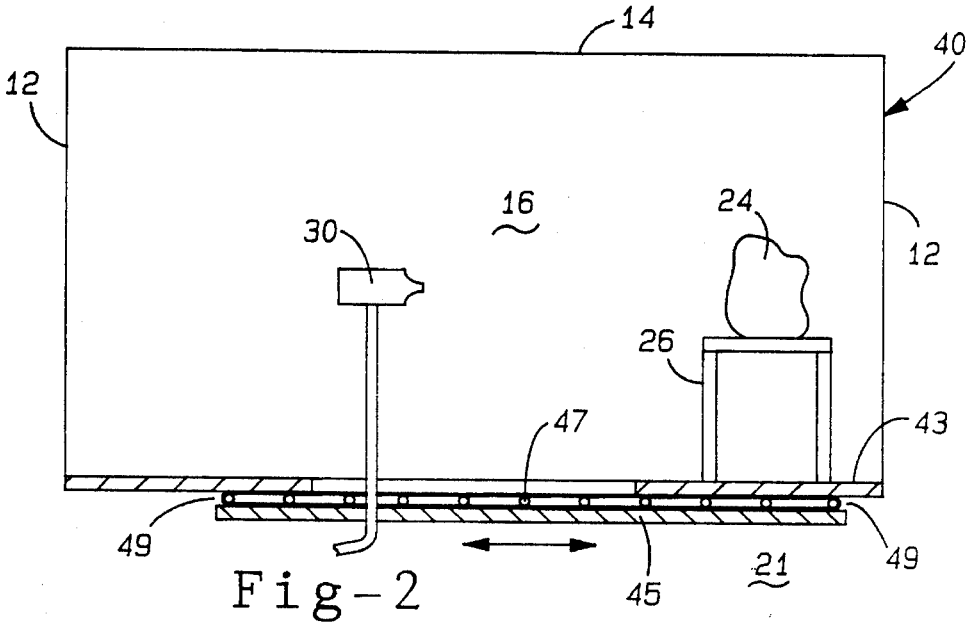
FIG. 2 is schematic side elevational view of a second embodiment of a spray apparatus in accordance with the invention.

A second embodiment of a chamber housing 40 is illustrated in FIG. 2. The chamber housing 40 has a floor 43 with a sliding access gun support plate 45 slideably mounted via slide mechanisms 47. The plate 45 is spaced apart from the floor 43 to provide elongate slots 49 that provide continuous gas exchange between the chamber 16 and the ambient exterior 21. In this way the slots 49 function as the continuously open aperture 18 while it allows the mounting of the access door 45 without the need for seals between the floor 43 and door 45.

As shown in FIG. 1, the size of the aperture 18 may be adjusted in accordance with the type of inert gas used, the flow rates used during the spray process and the differential pressure desired in the chamber. The adjustment of the aperture 18 may range from a predetermined minimum size that provides no exchange of gases with the ambient exterior atmosphere to a desired maximum size that allows a controlled amount of oxygen into the chamber.

For determining the desired minimum size of the aperture, i.e. the maximum size of the aperture for assuring inert atmosphere condition, the known formula for such inert atmosphere conditions is given by:

$$Q=1651\times A\times C\times\sqrt{h}/\sqrt{D}$$

where;

Q is flow rate required, in $ft^3$/hour

A is total opening area, $in^2$.

C is coefficient of discharge, set at 0.61 h is differential pressure, PSI

D is specific gravity of the gas

For Helium used as the purging gas:

D=0.138

Setting h at approximately 0.5 PSI and the Q at approximately 1500 scf/hour, we find that the total opening area is calculated to be a maximum of 0.8 $in^2$ for providing inert atmosphere conditions.

A total opening area that is greater than this minimum size will allow a significant exchange of exterior ambient atmosphere back into the chamber even though there may be a constant outwardly directed flow of purging and carrier gases from the chamber. This inward exchange of ambient exterior atmosphere can be due to turbulence at the aperture 18 or other factors that cause back wash or inward flow of the ambient exterior atmosphere. The inward flow of ambient atmosphere provides the introduction of oxygen into the chamber 16. The greater the size of the aperture above the calculated minimum size, the greater is the exchange of exterior ambient atmosphere back into the chamber. As such, the presence of oxygen in the chamber can be controlled based on adjusting the size of the aperture 18.

One advantage to allowing a permanent opening between the ambient exterior 21 and the chamber 16 is to allow installation of the lines 29, 33, 35 and 37 without the need for gaskets or seals with the floor 13 of chamber housing 11. Any clearance between the lines 29, 33, 35, and 37 should be taken into account as part of the open area calculated when determining the size of the adjustable aperture 18 shown in FIG. 1.

In certain applications, it may be desirable or necessary to apply the coating at above ambient exterior temperature. Temperatures above 100° C. are foreseen as desirable. The elevated temperatures may be obtained by preheating the substrate, preheating the carrier gases or purging gases, or using heating elements in the chamber 16 to heat the chamber 16.

It is foreseen that other gases can be used to protect the spray coating process against uncontrolled oxidation. Furthermore, combustion gases, such as products of oxygen and methane combustion can also be uses as purging or carrier gases. Where the purging and carrier gases are heavier than ambient atmosphere at the desired temperature, the aperture 18 is desirably located on the top 14 rather than the floor 13. Similarly, the lines 29, 33, 35, and 37 desirably enter the chamber 16 from the top 14.

For either chamber housing, 11 or 40, one possible commercially available spray gun can be the Gator-Gard™ high energy plasma system for applying Gator-Gard™ coatings available from Sermatech International, Inc. and as taught in U.S. Pat. No. 4,256,779 by Sokol et al, and incorporated herein by reference. Other thermal systems may be used such as HVOF processes. Other applications are foreseen using any thermal spray gun or plasma spray gun that is commercially known in the industry. The present invention can be used with all of the coatings that are presently used for plasma spraying, such as all of the metal powders that have been designed by manufactures to used for air spray applications. Other materials that are not easily sprayed in air can be readily applied with this method including MCrAlY coatings and reactive metals such as titanium.

The following example illustrates the benefits and advantages of the present invention. More specifically, the following examples provide experimental data that illustrate that the invention produces a plasma sprayed MCrA1Y coating that is equal in performance and visual quality when compared to the prior art coatings made from LPPS processes.

EXAMPLE 1.

Figure 3:
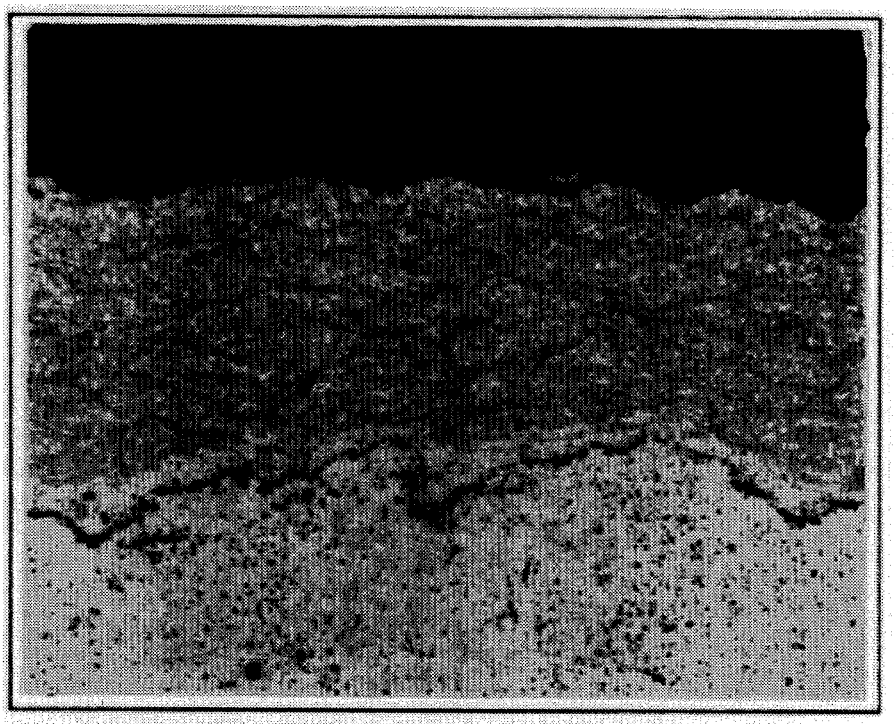
FIG. 3 is a photographic illustration at 500 magnification of a cross-section of a NiCoCrA1Y coating and substrate processes in ambient air.
Figure 4:
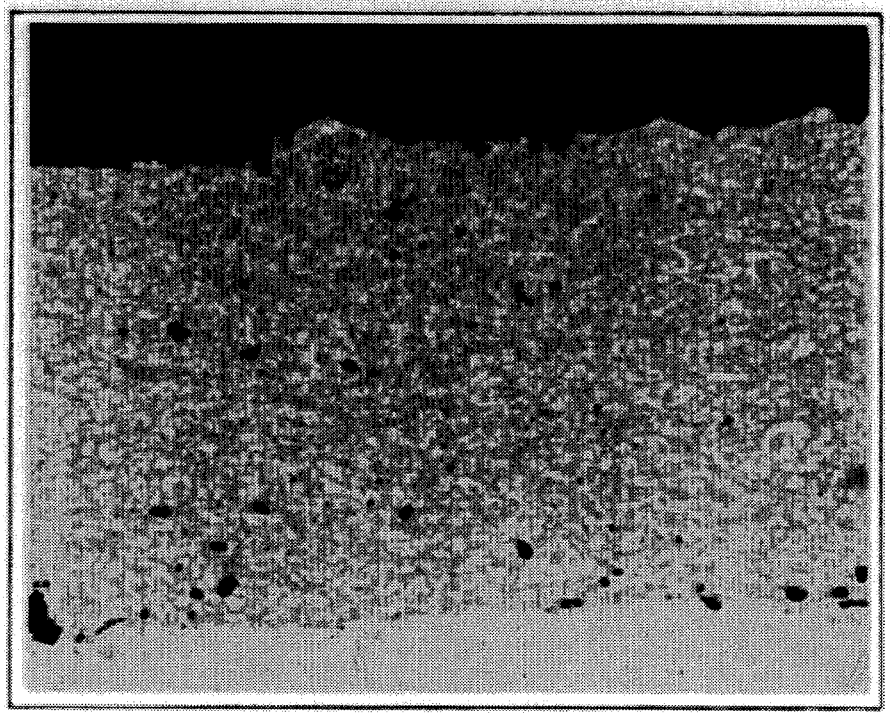
FIG. 4 is a view similar to FIG. 3 of a substrate and NiCoCrAiY coating from a chamber in accordance with the invention.

Reference is now made to FIGS. 3–6. By setting the values as mentioned above, a NiCoCrA1Y coating was processed in a chamber in accordance with the inventions and in air for comparison. The chamber was purged with helium. The helium based Gator-Gard™ process was used to apply the coating. Coating thickness was nominally 125 μm. Visual inspection of the magnified cross-sectional photomicrographs shown in FIGS. 3–4 are the common standard methods for checking the quality of adhesion and density of the coating onto the substrate. As shown in FIG. 4, the resulting NiCoCrA1Y coating produced at 450 ppm of $O_2$ with the part at 350° F. produced a coating that is comparable with LPPS. The dark spots are voids and are due to a combination of porosity in the coating and pull out during the polishing procedure. The resulting visual inspection shows that this coating is very dense and clean and is acceptable by most present standards in the aerospace gas turbine industry.

In contrast, a NiCoCrAlY coating produced in ambient air shown in FIG. 3 discloses fine oxides present in the interlamellar regions which are detrimental to the coating performance.

Figure 5:
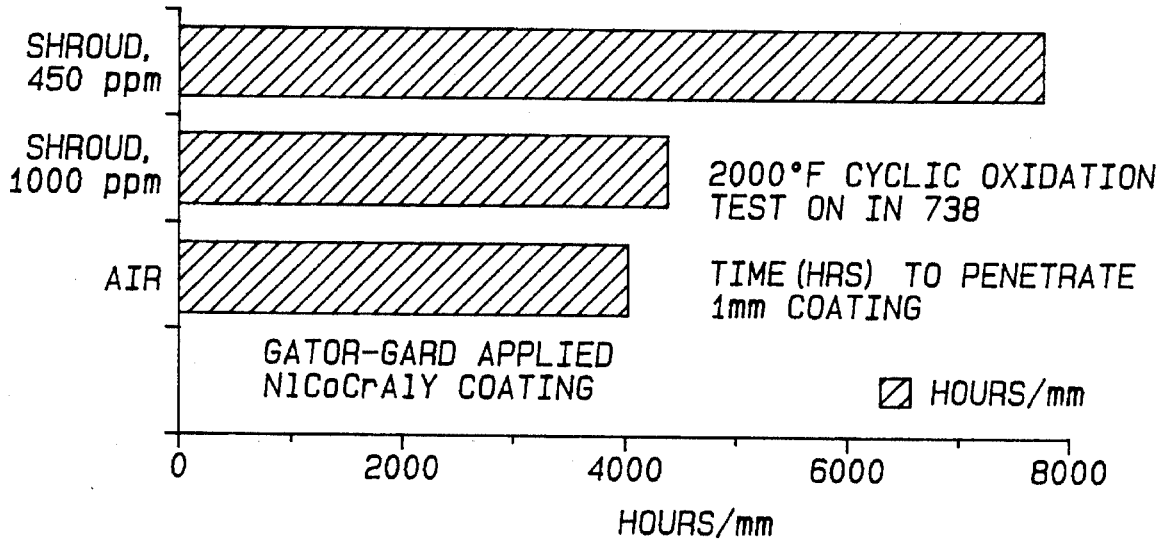
FIG. 5 is a graph illustrating oxidation performance testing of NiCoCrA1Y coatings produced in ambient air, and in chambers at 1,000 ppm of $O_2$ and at 450 ppm of $O_2$.

The performance of the coating shown in FIG. 4 has been tested and compared with the coating shown in FIG. 3. Oxidizing conditions produce oxide scales at the surface which are lost and repeatedly reformed which leads to loss of vital elements in the coating for durability. FIG. 5 illustrates that the coating applied at 450 ppm $\mathbf{0_2}$ content has a durability under oxidizing conditions double that of air sprayed coatings and comparable to coatings produced under LPPS conditions.

Figure 6:
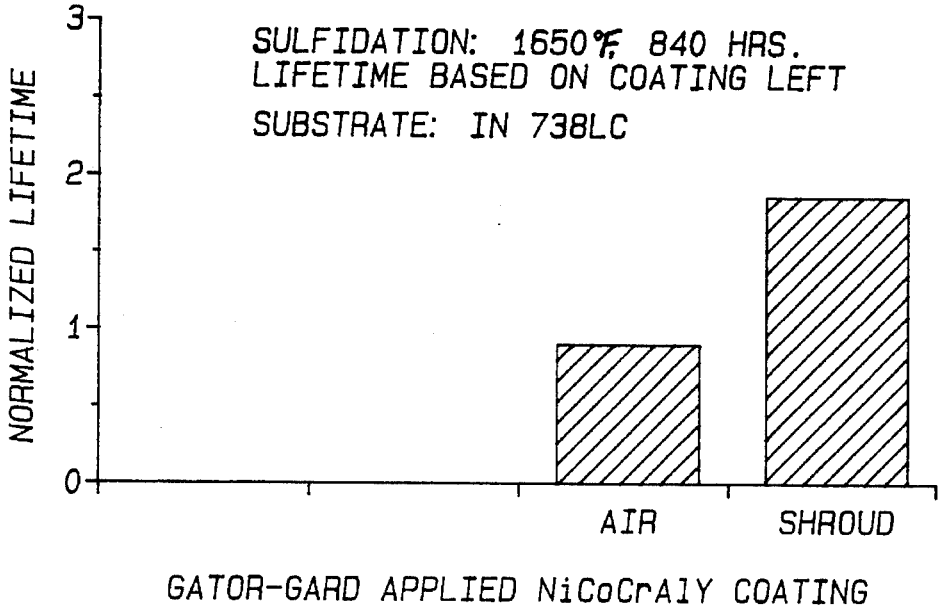
FIG. 6 is a graph illustrating sulfidation performance testing of NiCoCrA1Y coatings produced in air and in a chamber in accordance with the invention.

Sulfidation or hot corrosion conditions occur in a temperature range where the coating is attacked by condensed salts such as sodium sulfate. These salts attack the coating in a very rapid fashion and degrade the longevity of the coating. As shown in FIG. 6, the longevity under sulfidation conditions is also approximately double that of an air sprayed coating and comparable to coatings produced under LPPS.

Variations and modifications are possible without departing from the scope and spirit of the present invention as defined by the appended claims.

The embodiments in which an exclusive property or privilege is claimed are defined as follows:

1. A method of applying a thermal spray coating, said method including the steps of:

providing chamber having a spray nozzle and a separate purging gas injector therein and a restricted opening that is continuously open to ambient atmosphere that is exterior of said chamber;

disposing a substrate to be coated in said chamber;

substantially filling the chamber with a gas flowing from said purging gas injector which displaces oxygen from the chamber through the restricted opening, said gas being inert to the substrate, the chamber, and the thermal spray coating;

spraying the coating through the gas and onto the substrate;

maintaining a gas flow from said gas injector at a rate to maintain a positive outward flow of purging gas through said restricted opening in said chamber during the spraying of the coating and thereafter until said spray coating solidifies on said substrate;

a total area of said opening being a minimum of approximately 0.8 square inches to allow a controlled amount of oxygen to enter said chamber from said ambient exterior atmosphere; and said opening being adjustable in size.

2. A method of applying a thermal spray coating, said method including the steps of:

providing chamber having a nozzle device for introducing a gas and spray coating, said chamber having an adjustably sized restricted opening that is continuously open to ambient atmosphere that is exterior of said chamber;

disposing a substrate to be coated in said chamber;

adjusting the size of the restricted opening;

substantially filling the chamber with a gas flowing from said nozzle device which displaces oxygen from the chamber through the restricted opening, said gas being inert to the substrate, the chamber, and the thermal spray coating;

spraying the coating with a coating emitted from the nozzle device and directed to the substrate;

maintaining a gas flow from said nozzle device at a rate based on the size of the restricted opening and controlling an amount of oxygen that is be present during the spraying of the coating and thereafter until said spray coating solidifies on said substrate.

3. A method as defined in claim 2 further characterized by;

a total flow rate of gas emitted from the nozzle device being approximately 1500 cubic feet per hour at ambient temperature and pressure;

a total area of said adjustable opening being approximately 0.8 square inches.

4. A method as defined in claim 3 further characterized by:

said nozzle device includes a spray nozzle that sprays said coating and a carrier gas and a separate purging gas injector.

5. A method as defined in claim 4 further comprising:

a flow rate from said purging gas injector being approximately 800 cubic feet per hour at ambient temperature and pressure and a flow rate of carrier gas from said spray nozzle being approximately 700 cubic feet per hour at ambient temperature and pressure.

6. A method as defined in claim 3 further comprising:

the opening having a total area being a minimum of approximately 0.8 square inches to allow a controlled amount of oxygen to enter said chamber from said ambient exterior atmosphere.

7. A method as defined in claim 6 further comprising:

said opening being adjustable in size by an iris diaphragm.

8. An apparatus for applying a thermal spray coating onto a substrate, said apparatus characterized by:

a chamber housing defining a chamber and having a continuously open opening therethrough allowing fluid communication between the chamber and ambient exterior;

a gas source within said chamber for releasing a displacement gas into said chamber forcing oxygen containing air out through said opening;

a spray nozzle for spraying the coating through said gas in the chamber and onto a substrate in said chamber;

an adjustment pump mechanism for providing an adjusted flow of gas from said gas source to continuously provide a controlled flow of gases through said continuously open opening;

a total area of said opening being a minimum of approximately 0.8 square inches to allow a controlled amount of oxygen to enter said chamber from said ambient exterior atmosphere; and an adjustment device for adjusting the size of said opening.

* * * * *